US005354596A

United States Patent [19]

Chew et al.

[11] Patent Number: 5,354,596

[45] Date of Patent: Oct. 11, 1994

[54] DECORATIVE COVERINGS AND PRODUCTION METHODS THEREFORE

[76] Inventors: Nancy Chew, 3781 S. Unita St., Denver, Colo. 80237; Kevin C. Watts, 2068 S. Milwaukee, Denver, Colo. 80210

[21] Appl. No.: 625,549

[22] Filed: Dec. 10, 1990

[51] Int. Cl.[5] ..... D06N 7/04

[52] U.S. Cl. ..... 428/152; 428/153; 156/183; 264/282; 264/129; 162/112; 427/264; 427/275; 427/426; 427/430.1

[58] Field of Search ..... 162/112; 156/183; 264/282, 283, 129, 285, 339; 427/275, 264, 426, 430.1; 428/152, 153; 156/183

[56] References Cited

U.S. PATENT DOCUMENTS

| | | | |
|---|---|---|---|
| 368,493 | 8/1887 | Roosa | 156/183 X |
| 2,085,875 | 7/1937 | Sirovy | 427/264 X |
| 4,631,097 | 12/1986 | Kossuth | 156/183 X |

FOREIGN PATENT DOCUMENTS

| | | | |
|---|---|---|---|
| 395482 | 7/1933 | United Kingdom | 427/264 |

*Primary Examiner*—Shrive Beck

*Assistant Examiner*—Benjamin L. Utech

*Attorney, Agent, or Firm*—Timothy J. Martin; Dana S. Rewoldt

[57] ABSTRACT

A method for producing a decorative panel wall paper and the like out of a flat piece of creaseable material wherein the piece is first creased along a multitude of crease lines to form a relatively flat production blank configured with a topography having peak portions and valley portions formed by regions of the piece between various ones of the crease lines, comprising the step of either spraying a sprayable pigment onto at least one side of the piece in an oblique direction so that the sprayable pigment impinges and is retained on windward sides of the peak portions with valley portions and leeward sides of the peak portions being shielded from the sprayable pigment, or immersing the piece into a fluid dip to coat the surface portions with a film operative to alter the appearance thereof and thereafter forming a relatively flat production blank. The production blank may then be adhered to a support surface by interfacing the back surface of the blank and the support surface with an adhesive material and by flattening the blank into a substantially planar configuration.

29 Claims, 3 Drawing Sheets

DECORATIVE COVERINGS AND PRODUCTION METHODS THEREFORE

FIELD OF INVENTION

The present invention relates generally to coverings which are adapted to be placed on a surface. In particular, the present invention relates to methodologies for producing decorative panels which may be directly used as surface coverings or which may be used to create a pattern that may be reproduced in another media to then be used as a covering for a surface. Accordingly, the technological field of the present invention relates to decorative coverings such as, for example, in wallpaper, linoleum, vinyl coverings, plastic coverings, tiles and the like.

BACKGROUND OF THE INVENTION

The use of various coverings for surfaces in the human habitat have long been used both for protective and decorative purposes. For example, walls and ceilings have been traditionally protected and decorated by plaster, paint, tapestries, paneling, wallpaper, metal sheeting and tile, to name a few. On the other hand, floors have typically been covered by ceramic tiles, vinyl and plastic tiles and sheets, linoleum, carpet, parquet and wood slats, again, to name a few. Work stations, such as countertops, and even articles of furniture, such as tables, have been covered by ceramic or stone materials, metal sheets, thermoformed plastic sheets, paneling, veneer and the like.

As a result of the desirability of various finishes for such surfaces, there is a constant demand for new decorative coverings. Interior designers and others involved in selecting surface coverings typically seek out "new looks" to incorporate in the overall aesthetic presentation of living and work spaces. The present invention is directed to the production of unique decorative coverings which, according to the methodologies of the present invention may be constructed as "one of a kind" coverings or which may be fabricated as a master pattern reproducible in a variety of surface covering media.

SUMMARY OF THE INVENTION

It is an object of the present invention to provide new and useful methodologies for producing decorative coverings which provide a pleasing aesthetic appearance when applied to a surface to be covered.

Another object of the present invention is to provide products in the form of decorative coverings, which in part a rich, aesthetic look to a surface so covered.

It is a further object of the present invention to provide methodologies for the production of surface coverings, and coverings produced according to such methodologies, which provide an illusion of depth thereby giving a three dimensional appearance to a surface.

Still a further object of the present invention is to provide decorative coverings and methodologies for the production thereof which produces unique patterns which may then be reproduced by mass production techniques yet which patterns are relatively inexpensive to create.

According to the present invention, then, a general method is described for producing a decorative panel that is adapted to be supported on a surface. This broad method includes a first step of providing a flat piece of creaseable material which has a memory for creases placed therein. Next, the flat piece of material is crushed into a ball-like mass in order to crease the flat piece along a multitude of creased lines. The ball-like mass is then unballed to form a relatively flat production blank that has a front surface and a back surface. This production blank thus has topography which includes peak portions and valley portions formed by regions of production blank lying between various ones of the creased lines. A sprayable pigment is then sprayed onto at least one of the front and back surfaces of the production blank in an oblique direction so that the sprayable pigment impinges and is retained on the peak portions with the valley portions and lee sides of the peak portions being shielded from the sprayable pigment.

In the preferred method, the flat piece of creaseable material may be colored. Alternately, or in combination with using a colored piece of creaseable material, the ball-like mass formed from the piece of material may be immersed into a clear or tinted dip to form a film on the surface thereof in order to alter the appearance before it is unballed into the production blank. Where dipped, the production blank is dried before being sprayed with the sprayable pigment.

When the production blank is sprayed with a sprayable pigment, the oblique angle of incidence is preferably 45° or less to the plane of the production blank, and it is preferable that this angle of incidence be on the order of 10°–30°. Further, if desired, a plurality of sprayable pigments may be sprayed onto the selected front or back surface of the production blank. In which case, each sprayable pigment is sprayed in an oblique direction, and these oblique directions may preferably be different from one another. After forming a decorative panel, as described above, it may be adhered onto a selected support surface, for example, by interfacing the surface opposite the pigmented surface with an adhesive material and by flattening the decorative panel into a substantially planar configuration.

A plurality of decorative panels may be prepared by the above described method, and these decorative panels may be of uniform or different geometric shapes. According to the present invention, the plurality of decorative panels may be arranged with an organization on the support surface wherein at least some of the decorative panels have contiguous edges and, if desired, some of the decorative panels may overlay one another to enhance the three dimensional appearance. After adhering the decorative panel to the support surface, it may be coated with a sealing and/or glazing compound. Further, the decorative panel adhered to the support surface may form a production pattern and the additional step of reproducing the production pattern onto a decorative medium is described. Here, the decorative medium is selected from a group consisting of: wallpaper, vinyl covering material, fabric covering material, tile, plastic covering material and linoleum.

As an alternative to spraying the ball-like mass with a sprayable pigment, it is possible to utilize the film derived from dipping the ball-like mass to create the three dimensional effect. Here, the dip is preferably tinted and, after being dried, is flattened and adhered to the support surface. Again, a plurality of panels may be prepared and organized either with contiguous edges or with overlaying portions. A sealing and/or glazing compound may again be used, and the resulting panel or panels may be used as a production pattern.

While the above described methodologies set forth, in summary form, the broad and preferred steps in creating decorative panels according to this invention, this invention is also directed to the panels, themselves, where formed by the described processes.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENT

The present invention concerns surface coverings of a decorative nature and, in addition to the coverings themselves, specifically is directed to methodologies for producing decorative coverings having rich aesthetics yet which are relatively easy to produce either as unique "one-of-a-kind" artistic coverings or which may be used as a pattern for mass reproduction. Further, while this invention is described specifically with respect to a covering adapted to be adhered to a support surface, such as a wall, table top and the like, it should be understood that the methodologies described herein may be employed to produce two dimensional and three dimensional works of art.

Figure 1:
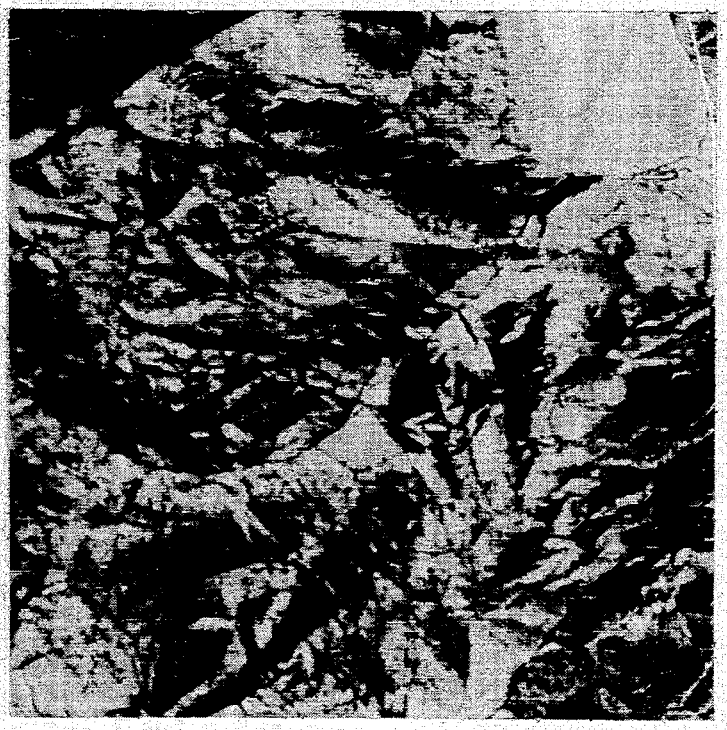
FIG. 1 is a photograph showing a decorative panel produced according to the present invention.

By way of explanation, references made to FIG. 1 which is a photograph of a two dimensional wall covering produced according to the preferred methodology of the present invention. Here it may be seen that covering 10 is in the form of a wallpaper covering wherein a plurality of panels 12 are organized to cover a wall surface. Thus, as described below in reference to FIG. 7(*c*), panels 12 have overlaying margin portions.

Figure 2:
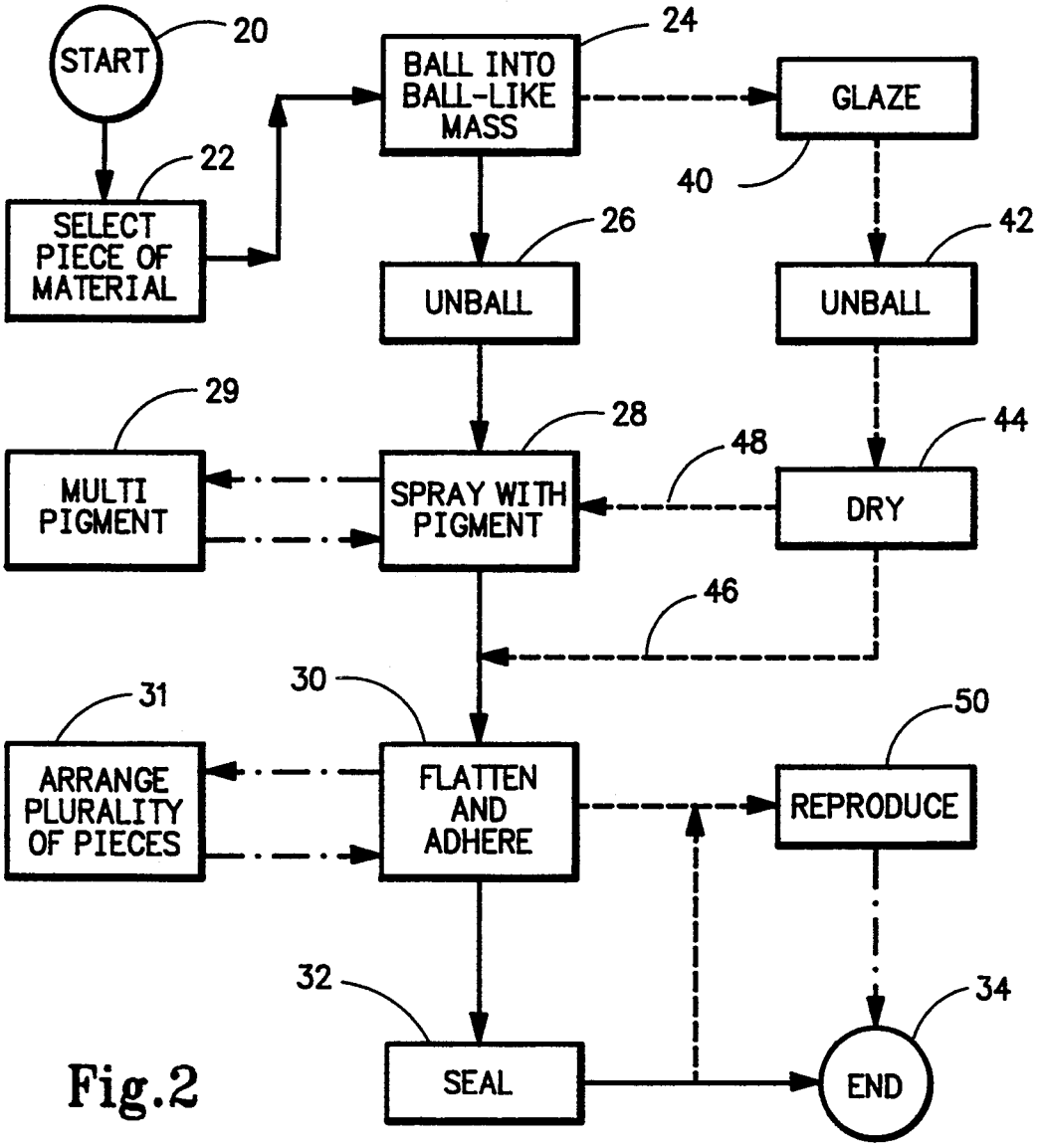
FIG. 2 is a flow chart showing the methodologies according to the present invention.

The various methodologies of the present invention are diagrammed in FIG. 2 which is a single flow chart showing the preferred methods and alternative processing steps which may be implemented depending upon the "look" desired for the resulting decorative covering. Reference will also be made in this description to FIGS. 3–7 which show the intermediate forms of a decorative panel used to create a covering such as covering 10.

Figure 3:
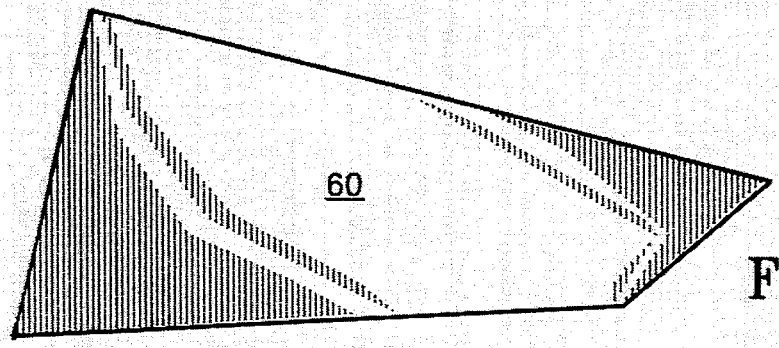
FIG. 3 is a top plan view showing a representative piece of creaseable material in a virgin state used with the present invention.

Turning, then, to FIG. 2, it may be seen that the processing starts at 20 and includes the first step of selecting a piece of creaseable material, as shown at 22. A representative piece of virgin creaseable material 60 is shown in FIG. 3 as an irregular quadrilateral piece of construction-type paper. It should be understood, however, that the piece of creaseable material may take any selected two dimensional geometric shape, as desired. It is important, however, that the material be creaseable so that it has a memory that will retain any crease lines placed on the material during processing. Any relatively stiff piece of paper may be used, and it should be understood that there may be other creaseable materials, such as plastic sheets or other materials either now existing or later developed, which may be employed with this process. The piece 60 may be colored, if desired, and may be selected on such artistic considerations as color, texture, grain, to name a few.

Figure 4:
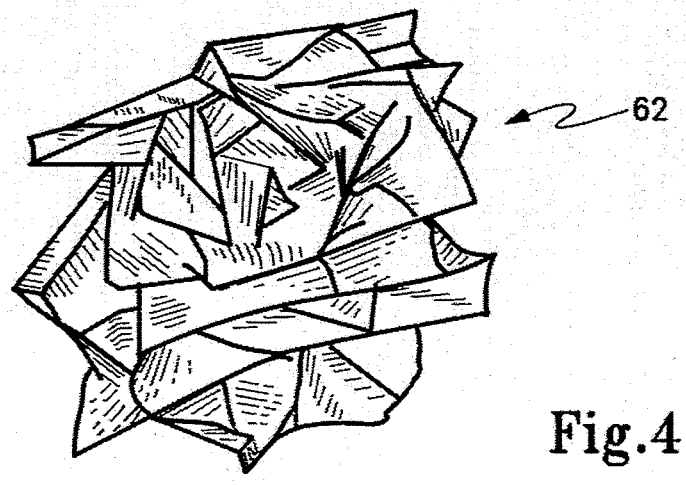
FIG. 4 is a side view in elevation showing the ball-like mass formed from the piece of material from FIG. 2.
Figure 6:
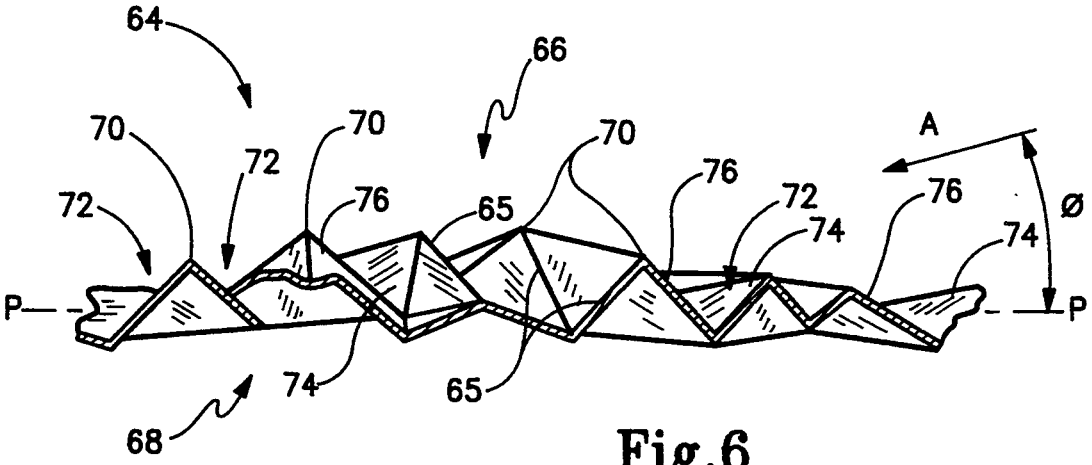
FIG. 6 is a cross-sectional view taken about lines of 6—6 of FIG. 5.
Figure 5:
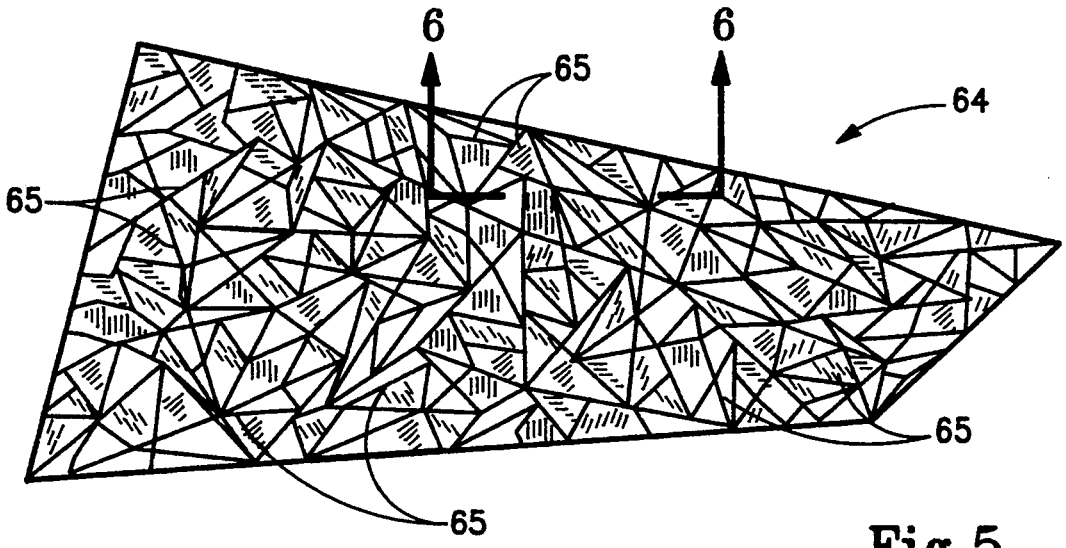
FIG. 5 is a top plan view of a production blank formed by unballing the ball-like mass of FIG. 3.

After selecting a piece of creaseable material, it is crumpled or crushed into a ball-like mass 62, as is shown in FIG. 4. This processing step, represented as step 24 in FIG. 2, randomly creases the piece of material 60 so that, when unballed at step 26, it will produce a production blank 64, shown in FIGS. 5 and 6. In FIGS. 5 and 6, it may be seen that production blank 64 has a front surface 66 and a back surface 68 which has a topography formed about crease lines 65. Crease lines 65 form a mosaic, as is shown in FIG. 5, and as best shown in FIG. 6, this mosaic results in a topography of a plurality of peak portions such as peak portions 70 and valley portions, such as valley portions 72, best shown in FIG. 6.

After production blank 64 is prepared, it is next processed, at processing step 28 (FIG. 2) by spraying production blank 64 in a direction represented by arrow A in FIG. 6, which direction is at oblique angle $\phi$ to the plane P of production blank 64. Oblique angle $\phi$ is preferably an acute angle of 45° or less, and best results have been obtained where angle $\phi$ is in a range of 10°–30°. When spraying the production blank 64 by a pigment material, it may be seen that peak portions 70 act to shelter valley portions 72 as well as lee sides 74. Accordingly, the sprayed pigment impinges on and is retained on the peak portions 70 and the unshielded or "windward" sides 76 thereof which are in the path of the pigment stream. With reference again to FIG. 2, it should be appreciated that production blank 64 may be sprayed with a single pigment or, as shown at processing step 29, may be sprayed with a plurality of pigments streams. Where a plurality of pigments are sprayed, it is preferable that they be performed sequentially and that the direction at which they are incident on production blank 64 varies so that a complex pattern of color is generated due to the difference in the oblique angles at which the respective pigment streams are directed as well as in the sheltering of different lee sides and the corresponding of retention of color on different windward sides of peak portions 70.

Figure 7A:
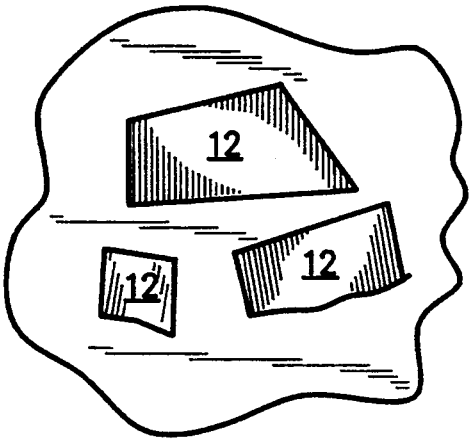
FIG. 7(*a*), 7(*b*) and 7(*c*) show alternate lay-outs of decorative panels on a support surface.
Figure 7B:
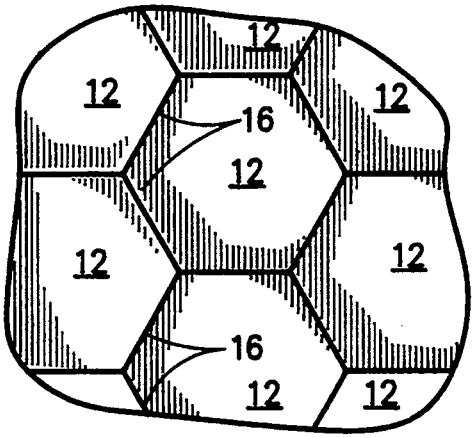
Figure 7C:
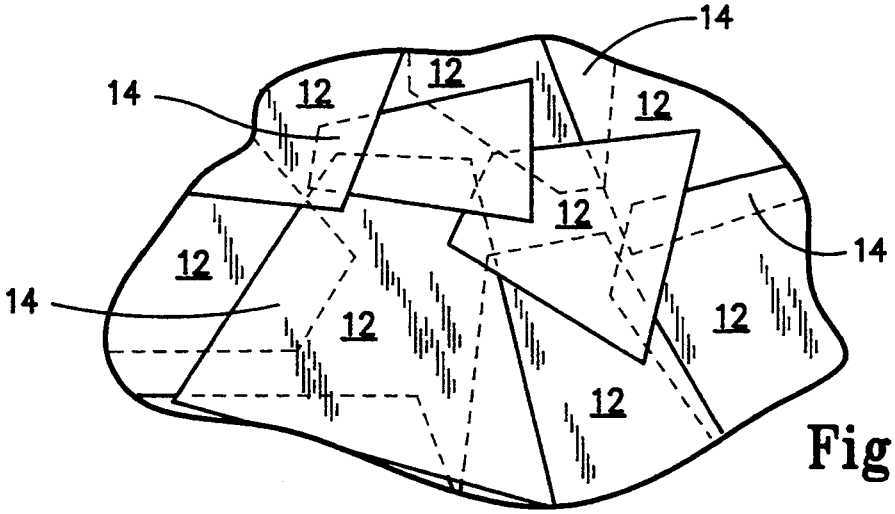

Regardless of whether a single pigment spray operation or a multi-pigment spray operation is used, after completion of the pigmenting, production blank 64 is flattened and adhered to a support surface, as shown at step 30, in FIG. 2. The step of adhering is accomplished by interfacing the surface to be covered and one side of production blank 64 with an adhesive material. Thus, for example, where front side 66 of production blank 64 has been processed with pigment, the back side 68 is treated with a suitable adhesive material and the production blank 64 is mounted onto a support surface and flattened, for example, by means of a roller sponge or other suitable implement. While a single decorative panel may be used, it may be seen in FIG. 1 that a plurality of panels 12 is preferable so that, as shown at processing step 31, a plurality of panels are arranged on a surface to be covered. Where such a plurality of pieces are used, edges of adjacent panels may be alternately spaced from one another, as is shown in FIG. 7(*a*) or they may be placed contiguously to one another, to have contiguous edges 16 and is shown in FIG. 7(*b*) or they may overlap one another as is shown in FIG. 7(*c*). Where panels 12 overlap one another, they have superimposed margins, such margins 14 in FIG. 7(*c*). This adds the additional appearance of depth to the resulting design. At any rate, after adhering panels 12 to the selected surface, the panels may, if desired, be covered by a sealing and/or glazing compound, such as a polyurethane, lacquer, varnish, shellac and the like, as is shown at step 32. The processing then ends, as shown at 34.

In the preferred methodology, an additional step of dipping is employed between the steps of forming the piece of material into a ball-like mass and spraying the material with pigment. Thus, with reference again to FIG. 2, it may be seen that ball-like mass 62 (FIG. 4) may be immersed, at processing step 40, into a fluid dip which may either be a clear or tinted transparent material in order to form a film on the surfaces of the production blank. For example, suitable dipping materials may include, for example, acrylics, polyurethanes, varnishes, lacquers, shellacs, etc. and the like. During the dipping step, it is sometimes desirable to squeeze the wetted ball-like mass to further enhance creasing and, after completion of the dipping, to wring excess fluid from the mass. Preferably, the dip is a dilute acrylic or an alkyd resin. Where a dip is used, the ball-like mass 62 is unballed at step 42 and is then dried, as is shown at step 44.

Since the formation of crease lines in conjunction with the film form the dip presents aesthetically pleasing designs on its own, especially where the dip is tinted with a background color, it is possible to go directly to the step of flattening and adhering the resulting panel, as is shown at alternate arrow 46 in FIG. 2, without the pigmenting step. However, in the preferred method, it is again desirable to spray the production blank 64 with pigment, as is shown at step 28 or a multiple of pigments as is shown at step 29. This path is shown by alternate arrow 48. Use of the dip material results in the thin film of transparent base that enhances the three dimensional effect produced by the topography of production blank 64, when sprayed with pigment at an oblique angle, and subsequently flattened. It is believed that this enhanced dimensional effect is caused by the almost imperceptible parallax view of the crease lines and the pigment material.

Regardless of whether a single panel is produced or a plurality of panels are used to create covering 10, it is contemplated by the present invention that the resulting covering may be used a pattern for mass reproduction, as is shown at processing step 50 in FIG. 2. Naturally, it should be understood that there is a tremendous variety of reproduction techniques available in the industry which may be implemented with a variety of different media. Thus, it is within the scope of this invention for the resulting covering or panel to be photographically reproduced as a master pattern that is then printed on various surface coverings such as: wallpaper, vinyl covering material, fabric covering material, tile, plastic covering material and linoleum. It should be understood, however, that this list is not intended to be exhaustive but is rather representative of some of the possible media in which the aesthetic design created by the present invention may be generated on a mass production scale.

As noted above, the present invention is primarily directed to the methodologies of producing decorative coverings. The decorative coverings, themselves are additional claims of this patent application where those decorative coverings are produced by the methodologies described herein.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. A method of producing a decorative panel adapted to be supported on a surface, comprising:

(a) providing a flat piece of creaseable material which has a memory for creases placed therein;

(b) creasing said flat piece along a multitude of crease lines to form a relatively flat production blank that has a front surface and a back surface and that is configured with a topography having peak portions and valley portions formed by regions of said production blank between various ones of said crease lines; and (c) spraying a sprayable pigment onto at least one of said front and back surfaces of said production blank in an oblique direction so that said sprayable pigment impinges and is retained on windward sides of said peak portions with said valley portions and leeward sides of said peak portions being shielded from said sprayable pigment.

2. The method according to claim 1 wherein said flat piece of creaseable material is colored.

3. The method according to claim 1 wherein creasing said flat piece includes the step of crushing said flat piece in to a balled mass, then immersing said balled mass into a fluid dip to coat the front and back surfaces thereof and to alter the appearance thereof before the step of unballing said balled mass into said production blank.

4. The method according to claim 3 wherein said balled mass is unballed into said production blank after the step of immersion into the fluid dip and said production blank is dried before being sprayed with said sprayable pigment.

5. The method according to claim 3 wherein said fluid dip is tinted with a background color.

6. The method according to claim 1 wherein said oblique direction is at an angle of forty-five degrees or less to said production blank.

7. The method according to claim 6 wherein said angle is between ten degrees and thirty degrees.

8. A decorative panel product made by the method of claim 6.

9. The method according to claim 1 including the steps of providing a plurality of sprayable pigments, and spraying at least one of a plurality of sprayable pigments onto said one of said front and back surfaces of said production blank, each sprayable pigment being sprayed in an oblique direction whereby each said sprayable pigment impinges on and is retained on said windward sides of said peak portions with said valley portions and said leeward sides of said peak portions being shielded from said sprayable pigments.

10. The method according to claim 9 wherein the oblique directions at which said sprayable pigments are sprayed are different from one another.

11. A decorative panel product made by the method of claim 9.

12. A decorative panel product made by the method of claim 1.

13. A method for producing a decorative surface covering on a support surface comprising the steps of:

(a) producing at least one decorative panel out of a flat piece of creaseable material which has a memory for creases placed therein whereby said piece is creased along a multitude of crease lines to form a relatively flat configured production blank that is configured with a topography having peak portions and valley portions formed by regions of said piece between various ones of said crease lines with said production blank having a front surface and a back surface and thereafter spraying a sprayable pigment onto said front surface of said production blank in an oblique direction whereby said sprayable pigment impinges on and is retained on windward sides of said peak portions with said valley portions and leeward sides of said peak portions being shielded from sprayable pigment; and (b) adhering said decorative panel onto a selected support surface by interfacing said back surface and said support surface with an adhesive material and by flattening said decorative panel into a substantially planar configuration.

14. The method according to claim 13 wherein a plurality of decorative panels are prepared and including the step of arranging said plurality of decorative panels with an organization on said support surface wherein at least some of said decorative panels have contiguous edges.

15. The method according to claim 13 wherein a plurality of decorative panels are prepared and including the step of arranging said plurality of decorative panels with an organization on said support surface wherein at least some of said decorative panels overlay one another.

16. The method according to claim 13 including the step of coating said decorative panel with a sealing compound after the step of adhering said decorative panel onto said support surface.

17. A decorative panel product by the method of claim 16.

18. The method according to claim 13 wherein said decorative panel is used as a production pattern after being adhered to said support surface and including the step of reproducing said production pattern on a decorative medium.

19. The method according to claim 18 wherein said decorative medium is selected from the group consisting of: wallpaper, fabric covering material, tile, plastic covering material and linoleum.

20. A decorative panel product made by the method of claim 18.

21. A method for producing a decorative surface covering on a support surface comprising the steps of:

(a) producing at least one decorative panel out of a flat pieced of creaseable material which has a memory for creases placed therein whereby said piece is first crushed into a balled mass to crease said piece along a multitude of crease lines after which said balled mass is immersed into a fluid dip to coat surface portions of said balled mass with a film operative to alter the appearance thereof and thereafter unballing said balled mass to form a relatively flat configured production blank that is configured with a topography having peak portions and valley portions formed by regions of said piece between various ones of said crease lines with said production blank having a front surface and a back surface; and (b) adhering said decorative panel onto a selected support surface by interfacing said back surface and said support surface with an adhesive material and by flattening said decorative panel into a substantially planar configuration.

22. The method according to claim 21 wherein a plurality of decorative panels are prepared and including the step of arranging said plurality of decorative panels with an organization on said support surface wherein at least some of said decorative panels have contiguous edges.

23. The method according to claim 21 wherein a plurality of decorative panels are prepared and including the step of arranging said plurality of decorative panels with an organization on said support surface wherein at least some of said decorative panels overlay one another.

24. The method according to claim 21 including the step of coating said decorative panel with a sealing compound after the step of adhering said decorative panel onto said support surface.

25. The method according to claim 21 wherein said decorative panel is used as a production pattern after being adhered to said support surface and including the step of reproducing said production pattern on a decorative medium.

26. The method according to claim 25 wherein said decorative medium is selected from the group consisting of: wallpaper, fabric covering material, tile, plastic covering material and linoleum.

27. A decorative panel product made by the method of claim 21.

28. A method for producing a decorative surface covering on a support surface comprising the steps of:

(a) producing at least one decorative panel out of a flat piece of creaseable material which has a memory for creases placed therein whereby said piece is creased along a multitude of crease liens to form a relatively flat configured production blank that is configured with a topography having peak portions and valley portions formed by regions of said piece between various ones of said crease lines with said production blank having a front surface and a back surface and thereafter spraying a sprayable pigment onto said front surface of said production blank in an oblique direction whereby said sprayable pigment impinges on and is retained on windward sides of said peak portions with said valley portions and leeward sides of said peak portions being shielded from sprayable pigment;

(b) adhering said decorative panel by flattening said decorative panel into a substantially planar configuration onto a selected support surface whereby said decorative panel can be used as a production pattern; and (c) reproducing said production pattern on a decorative medium.

29. A method of producing a decorative panel adapted to be supported on a surface comprising:

(a) providing a flat piece of creaseable material which has a memory for creases placed therein;

(b) creasing said flat piece along a multitude of crease lines by first crushing said flat piece into a balled mass and then unballing said balled mass to form a relatively flat production blank that has a front surface and a back surface and that is configured with a topography having peak portions and valley portions formed by regions of said production blank between various ones of said crease lines; and (c) spraying a sprayable pigment onto at least one of said front and back surfaces of said production blank in an oblique direction so that said sprayable pigment impinges and is retained on windward sides of said peak portions with said valley portions and leeward sides of said peak portions being shielded from said sprayable pigment.

* * * * *